US005600413A

United States Patent [19]

Kimura

[11] Patent Number: 5,600,413

[45] Date of Patent: Feb. 4, 1997

[54] METHOD AND APPARATUS FOR CONTROLLING THE POTENTIAL APPLIED TO A CONTACT CHARGER IN AN IMAGE FORMING APPARATUS

[75] Inventor: Shigeo Kimura, Kawasaki, Japan

[73] Assignee: Canon Kabushiki Kaisha, Tokyo, Japan

[21] Appl. No.: 280,986

[22] Filed: Jul. 27, 1994

[30] Foreign Application Priority Data

Jul. 27, 1993 [JP] Japan ..... 5-205797

[51] Int. Cl.[6] ..... G03G 15/02; G03G 21/00

[52] U.S. Cl. ..... 399/174; 399/169

[58] Field of Search ..... 355/219, 218, 355/243, 222, 227, 274, 275, 277

[56] References Cited

U.S. PATENT DOCUMENTS 5,099,283 3/1992 Maruyama ..... 355/218
5,450,170 9/1995 Kimizuka et al. ..... 355/218

FOREIGN PATENT DOCUMENTS 2-301778 12/1990 Japan .

*Primary Examiner*—Shuk Yin Lee
*Attorney, Agent, or Firm*—Fitzpatrick, Cella Harper & Scinto

[57] ABSTRACT

An image forming apparatus includes an image bearing member for bearing an image; a charging member contactable to the image bearing member to electrically charge the image bearing member, wherein a toner image is formed on the image bearing member using electric charge provided by the charging member; a transfer device for transferring the toner image from the image bearing member onto a transfer material; a controller for switching a potential applied to the charging member to form a blank area at a predetermined position of the transfer material; wherein the following is satisfied for formation of the blank area;

$$X \leqq t \times VPS \leqq 10$$

where VPS (mm/sec) is a moving speed of the image bearing member, t (sec) is a switching period of the controller, and X (mm) is a distance from a charge starting position to a charge ending position in a direction of movement of the image bearing member.

17 Claims, 5 Drawing Sheets

METHOD AND APPARATUS FOR CONTROLLING THE POTENTIAL APPLIED TO A CONTACT CHARGER IN AN IMAGE FORMING APPARATUS

FIELD OF THE INVENTION AND RELATED ART

The present invention relates to an image forming apparatus such as a copying machine, a laser beam printer or the like, more particularly to an image forming apparatus in which a toner image formed on an image bearing member such as a photosensitive member or a dielectric member is transferred onto a transfer material.

In an image forming apparatus such as a copying machine, a laser beam printer or the like, a transfer material having received an image by contacting to the surface of the image bearing member is passed through an image transfer position and is gradually separated from the surface of the image bearing member to be fed to an image fixing means.

(1) When a roller type fixing means, for example, is used, a non-image area (blank) is provided in 5 mm for example at the leading edge of the transfer material as effective means for easy separation of the leading edge of the transfer material from the fixing roller. More particularly, the portion of the image bearing member corresponding to the non-image area described above, of the leading edge portion of the transfer material does not bear a transferable image (toner image).

(2) When a contact type transfer means such as transfer roller or the like contacted to the backside of the transfer material is used, when the image is formed to the trailing edge of the transfer material, the developer (toner) on the image bearing member surface scatters with the result of contamination of the transfer roller with the developer. If this occurs, the backside of the transfer material is contaminated. In order to avoid this, complicated means to clean the transfer roller.

As an effective means for preventing or reducing contamination of the transfer roller with the developer, the no image area (blank) is provided in 5 mm for example at the trailing edge of the transfer material. More particularly, no transferable image (toner image) is formed on the portion of the image bearing member corresponding to the non-image area described above at the trailing edge of the transfer material.

(3) When the image is formed with reduced scale, non-image area (masking portion) is desired at a desired position with desired width in the range from the leading edge to the trailing edge of the transfer material.

As a means for easy and smooth separation of the transfer material from the image bearing member surface (1), as a means for preventing or reducing contamination of the transfer roller with the developer, and as a means for providing the non-image formation area at the leading edge portion, trailing edge portion or any portion therebetween on the transfer material for the purpose of masking, the conventional means in the case of electrophotographic apparatus, for example, is such that a desired area on the photosensitive member (image bearing member) having been electrically charged is exposed to light to provide a no-image area (non-charged area) to prevent the developer deposition.

However, this system using the exposure requires complicated and bulky apparatus.

As an improvement, Japanese Laid-Open Patent Application No. 301778 under the name of the assignee of this application has proposed that the fact that the charging width of the contact charging means such as a charging roller or the like has the primary charger is small, is positively charged so that the applied voltage to the contact charging member is controlled and changed so as to provide the blank region on the transfer material.

However, in this voltage Shifting control system, the following problems arise. When the shift switching period T is long, (1) the leading edge and the trailing edge of the image are not sharp-cut, that is, the image density gradually changes at the leading and trailing edges of the image, and (2), the leading edge and the trailing edge of the image are deviated in the high density portion and the intermediate density portion. More particularly, the potential of the image bearing member when the shift control is used at the leading edge of the image, is as shown by D in FIG. 3, but the intermediate density portion exposed to some extent, is as indicated by H.

As shown in FIG. 3, there occurs time difference between the development start position (A) of high density hardly exposed to light and the development starting position (B) of the intermediate density exposed to light to some extent, and therefore, the image starting position is different depending on the image density. The same applies to the trailing end portion.

Here, the switching period T is the time required for 90% change of the shift voltage when the voltage shifting is carried out. When the applied voltage is an oscillating voltage, the shift control is effected for the center of the oscillating voltage.

The problems (1) and (2) with the image are worse if the process speed is higher and if the switching period T is longer.

On the other hand, too short switching period of the shifting control is not desirable because:

(1) Overshooting tends to occur upon the switching.

(2) Noise may occur with the result of malfunction.

In order to avoid these problems, some measures have to be taken in the voltage source with the result of complicated and bulky apparatus.

(3) Additionally, abrupt voltage change produces rash current with the result of damage to the contact charging member or the image bearing member, and therefore, the service life is shortened.

For the above reasons, the switching period should not be too short.

If a voltage of the same polarity as the toner (opposite from the charging polarity of the primary charger) is applied to the transfer roller in order to return the toner deposited on the transfer roller to the photosensitive member, the problem of memory remaining in the photosensitive member arises. The memory reduces the potential in the subsequent image formation, so that the image is blurred.

In order to prevent the production of the memory, it is known that the cleaning area of the photosensitive member to which the toner is returned from the transfer roller is charged by the primary charger beforehand. However, if the area of the photosensitive member corresponding to the blank area for providing blank area on the end portions of the transfer material is not charged by the primary charger, the switching control of the voltage applied to the primary charger is complicated because the potentials are different between the cleaning area of the photosensitive member and the area corresponding to the blank area or areas.

SUMMARY OF THE INVENTION

It is a principal object of the present invention to provide an image forming apparatus in which the boundary between the image area and the blank area is sharp.

It is another object of the present invention to provide an image forming apparatus in which the deviation between an end of high density portion of an image and an end of an intermediate density portion is reduced.

It is a further object of the present invention to provide an image forming apparatus in which production of transfer memory is prevented.

It is a further object of the present invention to provide an image forming apparatus in which a blank area is formed on a transfer material by switching potential applied to a charging member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the embodiments of the present invention will be described.

Figure 1:
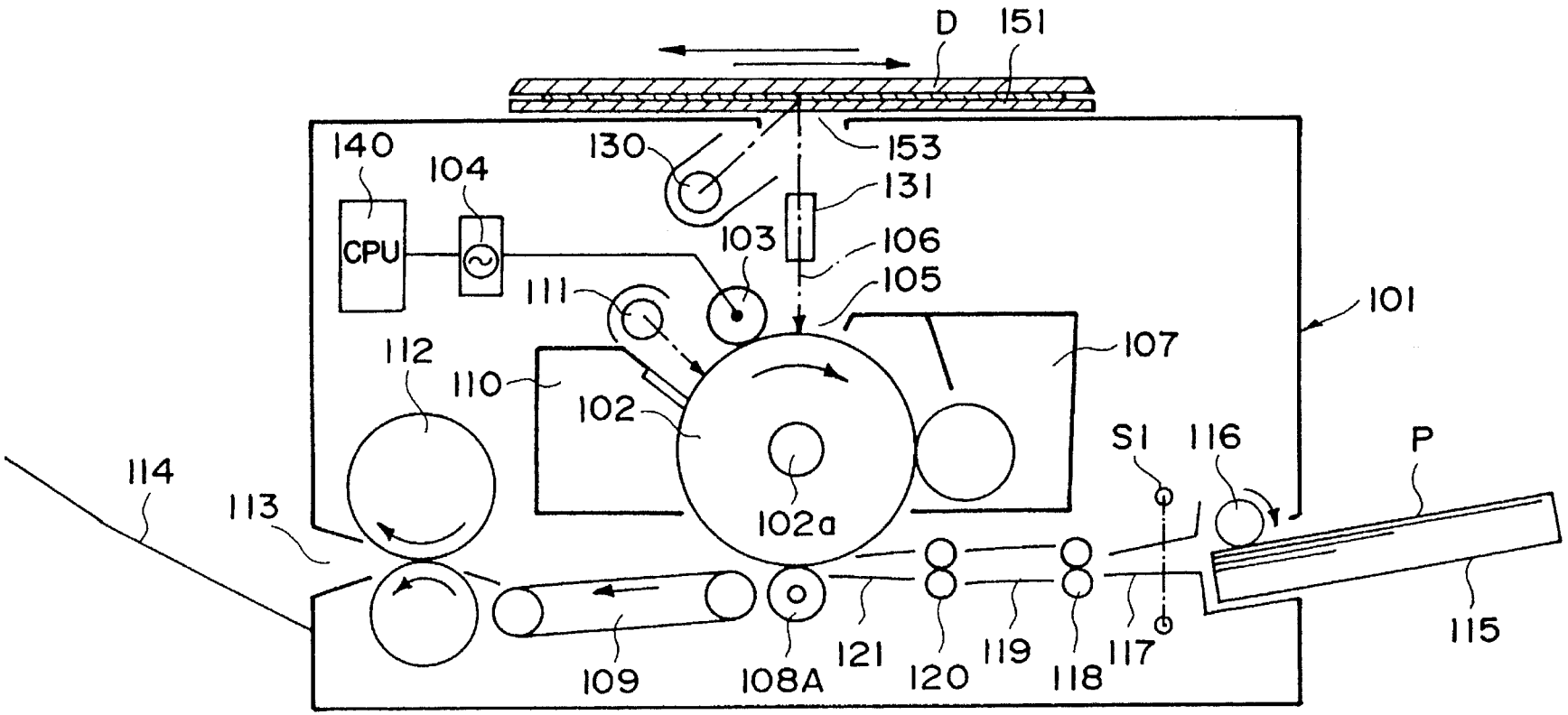
FIG. 1 is a sectional view of an image forming apparatus according to an embodiment of the present invention.

Referring to FIG. 1, there is shown an image forming apparatus according to the present invention.

The image forming apparatus 101 comprises an electrophotographic photosensitive drum 102 as an image bearing member. It is rotated about a shaft 102*a* in a clockwise direction indicated by an arrow at a predetermined peripheral speed (process speed). In this embodiment, the photosensitive member comprises an organic photoconductor layer of the negative charging property.

A contact charging member 103 functions as a primary charger for uniformly charging the peripheral surface of the photosensitive member 102 to the negative polarity. In this embodiment, the contact charging member 103 is of a roller type comprising conductive rubber or the like, and is press-contacted to the surface of the photosensitive member 102 with a predetermined pressure and is driven by the rotation of the photosensitive member. A voltage source 104 supplies the voltage to the contact charging member 103. In this embodiment, the voltage applied thereby is an oscillating voltage in the form of an AC biased DC voltage, more particularly it is a superposed voltage of an AC voltage having a peak-to-peak voltage of 1800 V and a DC voltage of −600 V (AC+DC). The level of the DC voltage DC is the center of oscillation. The photosensitive member 102 is uniformly and gradually charged to a predetermined potential while it is rotated, by the charging member 103 applied with the voltage. The peak-to-peak voltage of the oscillating voltage is preferably not less than twice a charge starking voltage for the photosensitive member for the purpose of preventing charge non-uniformity of the photosensitive member in the form of spots. The charge starting voltage is a DC voltage when the charging of the photosensitive member starts, if only a DC voltage is applied between the photosensitive member and the contact charging member. The waveform of the oscillating voltage may be a sine, triangular, rectangular wave, but the oscillating voltage may be formed by combining a DC voltage and an AC voltage formed by repeating on and off a DC voltage source.

The surface of the photosensitive member 102 uniformly charged by the charging member 103 is exposed to the image of the original through a slit 106 in the exposure station 105. By this, an electrostatic latent image is formed corresponding to the exposing light pattern on the surface of the photosensitive member 102. The electrostatic latent image is developed into a toner image with toner of the positive polarity by the developing device 107, and then reaches to a transfer station where a nip is formed between the transfer charger (transfer roller) 108A and the photosensitive member 102. A transfer material P is fed one by one into the apparatus 101 by sheet feeding rollers 116 and a separation member from a cassette 115 in a sheet supply station, and is fed to a transfer position where a transfer charger 108A supplied with the negative voltage is opposed to the photosensitive member 102, in synchronism with the rotation of the photosensitive member 102, by way of a guide 117, a pair of feeding rollers 118, a guide 119 and a timing roller pair (registration roller) 120 and a guide 121. Onto the surface of the transfer material P, the toner image is gradually transferred from the surface of the photosensitive member 102. The transfer material P having passed through the transfer station is separated from the surface of the photosensitive member 102, and is introduced into a fixing device 112 by a feeding device 109, and the image is fixed thereon. Finally, the sheet is discharged through a discharge outlet 113 onto a discharge tray 114.

After the transfer material is separated, the surface of the photosensitive member 102 is cleaned by a cleaning device 110 so that the residual toner or other contamination are removed. Thereafter, residual electric charge is removed by a discharger in the form of a whole surface exposure device 111 or the like. Then, the photosensitive member is prepared for the next image forming operation.

In response to a copy start signal, an original supporting platen, 151 is reciprocated. The bottom surface of the original D placed on the original supporting platen glass 151 is illuminated by light 130 from one side to the other side during the movement of the platen glass 151 by way of a slit 153, and the light reflected by the surface of the original is imaged through a short focus lens array 131 on the surface 105 of the photosensitive drum 102 having been charged by the charging roller 103, so that an electrostatic latent image is formed on the photosensitive member 102 surface corresponding to the original image. The latent image is developed by a developing device 107.

The image forming apparatus of this embodiment has a process speed VPS of 10.0 m/sec. The central voltage (DC voltage) of the oscillating voltage is set to 0 volt for non-image formation area and set to −600 v during the image formation, by a control circuit 140. The switching of the applied voltage is synchronized with feed of the transfer material P. The switching period T is 50 msec. Therefore, 5 mm width non-image areas are formed at the leading and trailing edges of the transfer material, thus providing non-image area (blank area). By forming non-image area at the leading edge, the transfer material P can be easily separated after passing through the fixing roller in the fixing device 112. In addition, by the trailing non-image area, the contamination of the transfer roller 108A due to the developer scattering at the transfer operation for the trailing edge of the transfer material, can be prevented. The non-image area is an area in which no toner image is formed for any image information of the original.

The voltage control sequential operation will be further described. A sheet sensor (photosensor) S1 detects feeding of the transfer material P from the sheet supply station, and the photosensitive member 102 starts to rotate, and the original D is scanned. The contact charging member 103 is supplied with only an AC voltage (1800 V in the peak-to-peak voltage), that is, having a central voltage of 0 V, is applied. In synchronism with the timing roller pair 120, the central voltage is shifted from 0 V to −600 V in the period of 50 msec at the timing for image formation 5 mm after the leading edge of the transfer material, and then, the photosensitive member 102 starts to be charged.

When the DC component of the voltage applied to the charging member 103 is 0 V, that is, when only the AC voltage is applied, the surface of the photosensitive member 102 is electrically discharged to provide a surface potential of 0 V, and therefore, no toner image will be formed. When the DC voltage component is applied to the charging member, the charging of the surface of the photosensitive member 102 starts.

The charging operation of the charging member 103 for the surface of the photosensitive member 102 starts 5 mm after the leading edge of the such an area of the photosensitive member as corresponds to the transfer material P, by the control sequence for the application of the voltage to the contact charging member 103, as described above. By doing so, the transfer material P contacted to the surface of the photosensitive member 102 to receive the image does not have any toner image in the region of 5 mm from the leading edge thereof (blank).

Here, by selecting the switching period T for the shift control to 50 msec relative to the process speed VPS=100 mm/sec. the sharp edge can be provided at the end without gradual density, and in addition, the deviation between the high density portion such as a solid black or a line image and an intermediate density (VH) portion, is only 1–2 mm, which is not a problem.

Similarly, the trailing edge of the transfer material is detected by a sensor S1, and the central voltage is switched from −600 V to 0 V with the switching period T=5 msec, at the timing for providing non-image area from 5 mm before the trailing edge of the transfer material. By doing so, a sharp trailing edge of the image can be provided.

Through the experiments of the inventors, in the case of the image forming apparatus having a process speed VPS= 100 mm/sec, a low density blurred region is formed at the leading edge portion of the image if the switching period T of the shifting control is larger than 100 msec under the condition of usual developing bias level although the value of the period depends on the applied developing bias voltage. When the image includes a high density portion and an intermediate density portion, the end edge portions of the high density and intermediate density portions are deviated by not less than 5 mm with each other, and the edge is not smooth, and therefore, the image is poor.

If the switching period T of the shift control is shortened, the sharpness at the reading and trailing edges are improved, and the deviation between the high density portion and the intermediate portion decreases. However, if the switching period T is less than 20 msec, the sharpness is not improved any more. In this embodiment, a voltage is instantaneously applied to charge the image bearing member while the image bearing member 102 and the charging roller 103 are not rotated (at rest), and thereafter, the image bearing member 102 is rotated, and the charged area is developed. Then, a development width is measured in a direction of the movement of the photosensitive member. By doing so, a distance X from the charge starting position to the charge ending position (FIG. 2) by the charging member in the direction of the movement of the photosensitive member, can be determined. In this embodiment, the distance X is 2 mm, and in addition, it has been found that the sharpness at the boundary between the blank area and the image area does not change even if the switching period T is shorter than the time required for the photosensitive member passes through the distance X.

With the reduction of the switching period T, it becomes difficult to prevent occurrence of voltage overshoot upon the switching operation with the result that the photosensitive member 102 at the leading and trailing edge of the image is overcharged so that density non-uniformity occurs in 3 cases. In addition, the rash current during the switching period T may damage the photosensitive member 102.

The similar experiments are carried out with an image forming apparatus having a process speed VPS of 200 mm/sec. It has been confirmed that the good non-image area can be formed at the leading and trailing edges when the switching period T is not more than 50 msec. However, no improvement is observed by the reduction of The switching period T if it is not more than 10 msec.

Figure 2:
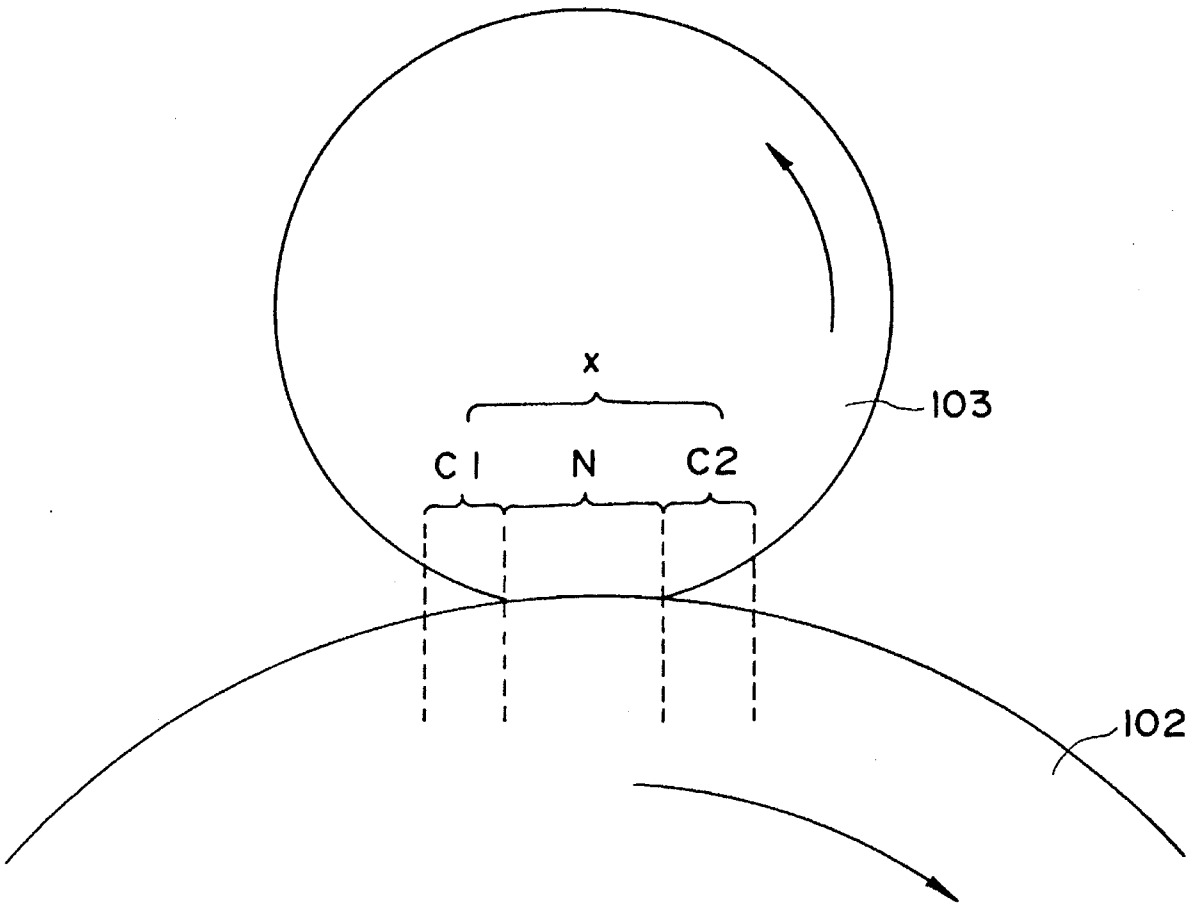
FIG. 2 is a sectional view of a charging area by a charging member.
Figure 3:
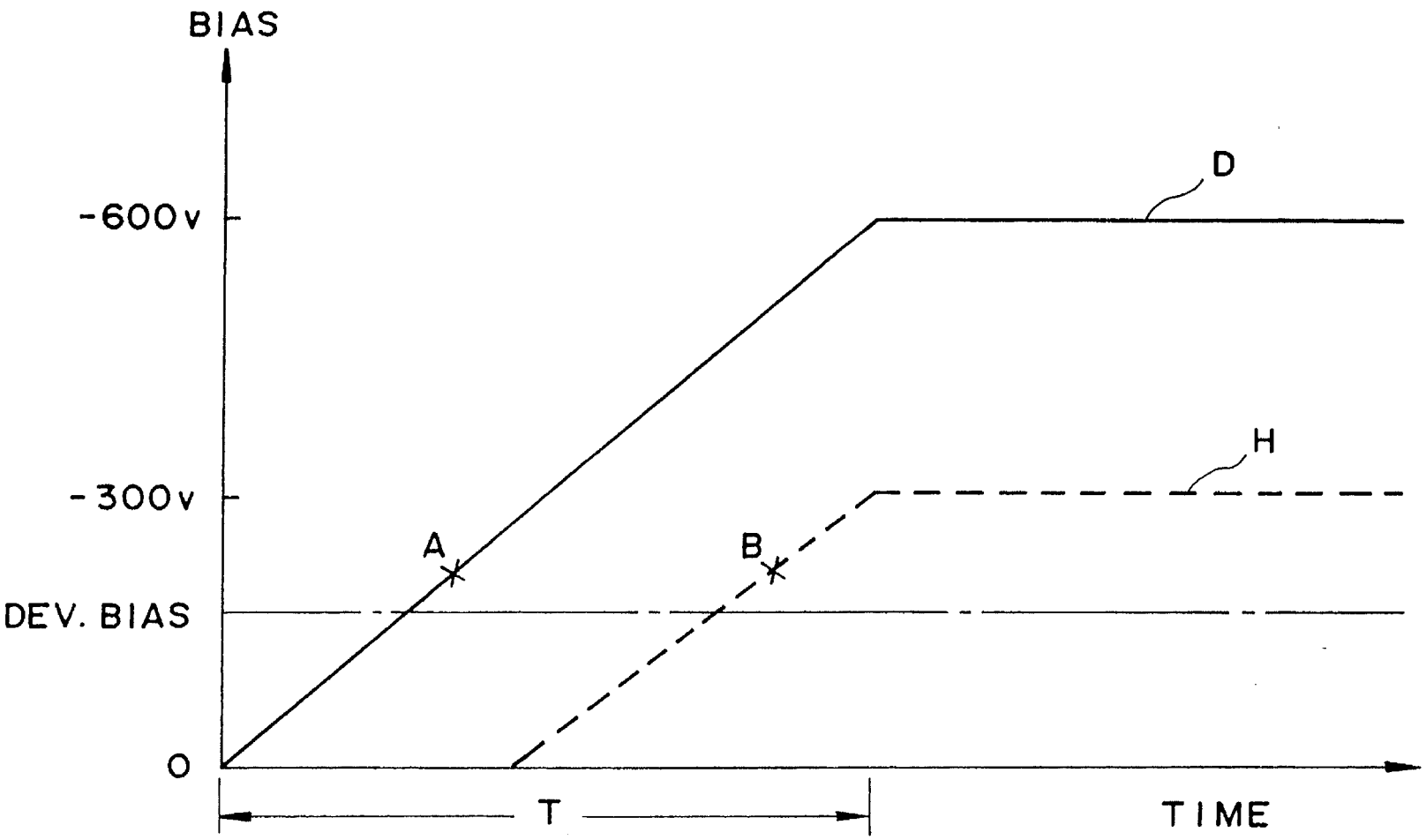
FIG. 3 is a graph of a potential of a photosensitive member in a high density portion and an intermediate density portion adjacent a leading edge of the image.

From various experiments of the inventors, the satisfactory blank area can be provided on the transfer material if $X \leqq T \times VPS \leqq 10$ (mm) is satisfied, where X (mm) is a distance, VPS (mm/sec) is a process speed, T (sec) is a switching period of the voltage applied to the charging member for formation of the blank area. The distance X, as shown in FIG. 2, is a sum of a nip width N formed between the charging member 103 and the photosensitive member 102, a discharging width C1 of the charging member at an upstream of the flip with respect to the movement direction of the photosensitive member, and a discharging width C2 of the charging member downstream of the nip with respect to the same direction.

In the foregoing embodiment, the applied voltage to the charging member 103 is −600 V during image formation, and 0 V non-image formation area providing operation, without the developing bias shifted.

In another embodiment which will be described, the applied voltage is shifted to −300 V for example for the non-image area, and in synchronism therewith, the developing bias voltage is shifted to −350 V, for example, with which the toner is not developed. In this manner, the non-image area is provided.

Figure 4:
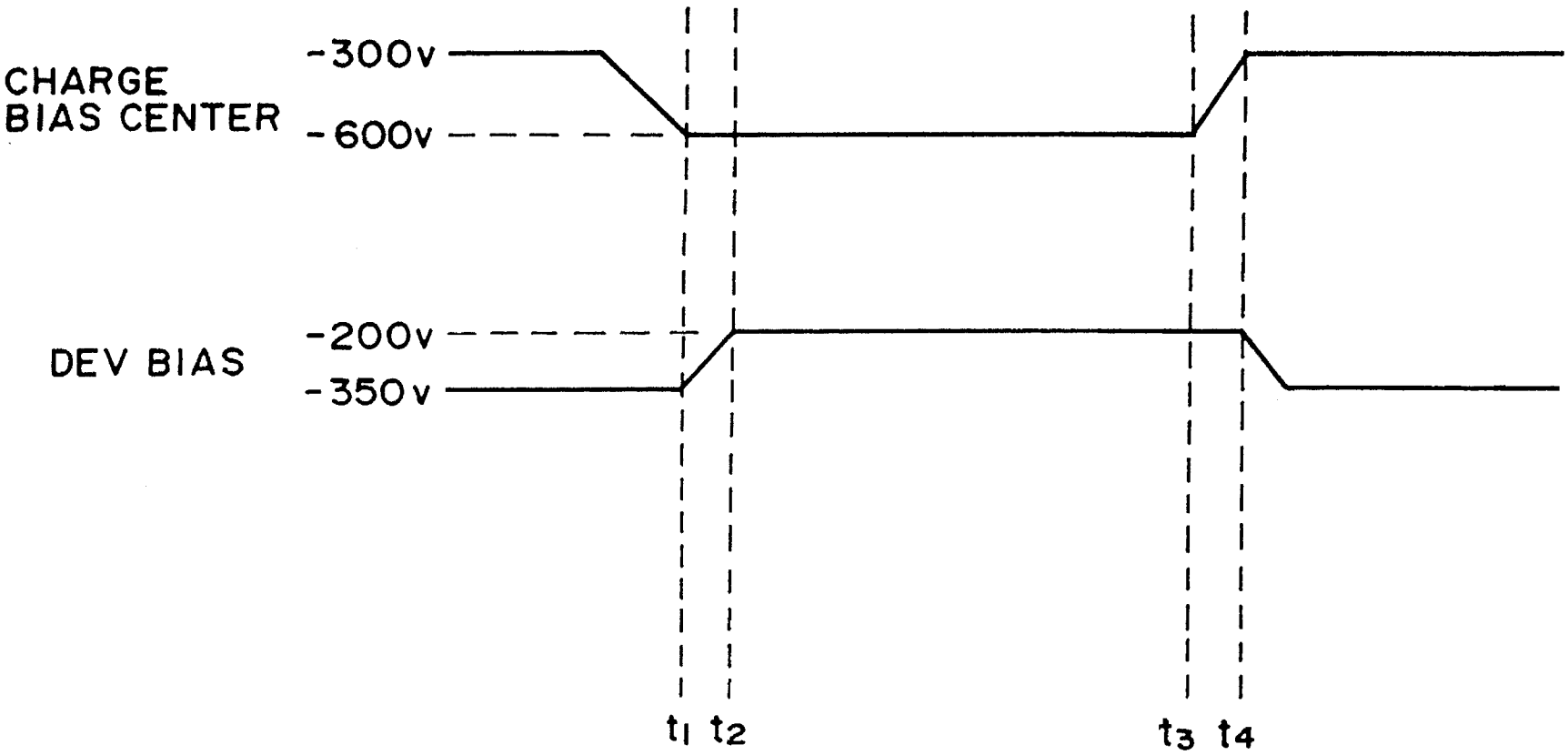
FIG. 4 is a timing chart of a charger and a developing device of an image forming apparatus.

As shown in the timing chart of FIG. 4, the central voltage is shifted from −300 V to −600 V at the timing $t_1$ for formation of the image from 5 mm after the leading edge of the transfer material, and the developing bias voltage is also shifted from −350 V to −200 V, for example, for the formation of the optimum density image at timing $t_2$ for the formation of the image 5 mm after the leading edge of the transfer material. The time period $t_2$–$t_1$ corresponds to the time required for the photosensitive member 102 to move from the charging position to the developing position. At the trailing edge of the image, the reversed shiftings are carried out so that the non-image area is provided.

The central voltage is shifted from −600 V to −300 V at timing $t_3$ so that the blank region is formed at the trailing edge of the transfer material in FIG. 4. In addition, the developing bias voltage is shifted from −200 V to −350 V at timing $t_4$. The time period $t_4-t_3$ is equal to $t_2-t_1$.

Figure 5:
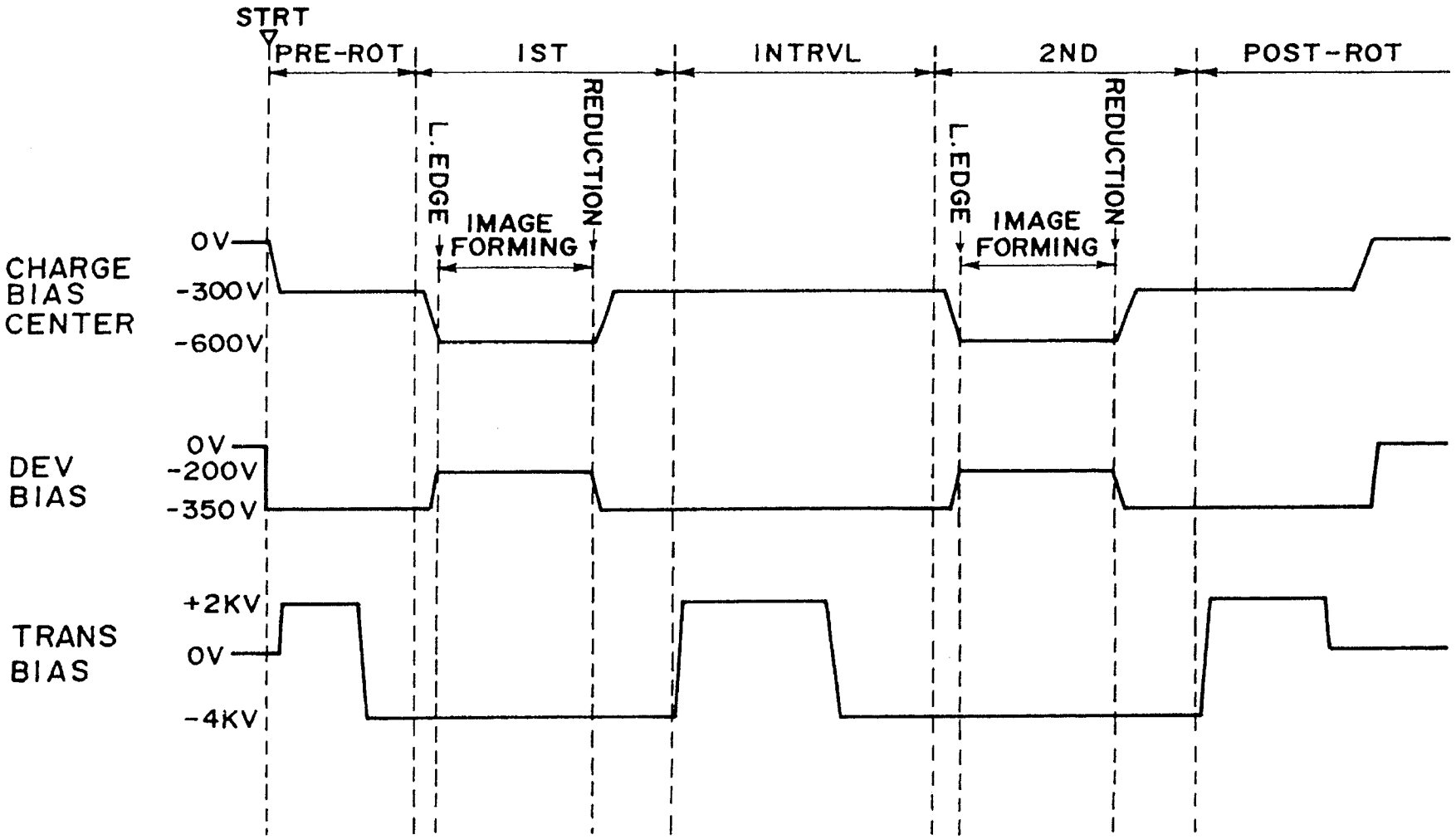
FIG. 5 is a timing chart of a charger, a developing device and a transfer charger of an image forming apparatus.

FIG. 5 is a timing chart of the central voltage of the image transfer bias as will as the central level of the charging bias and the central level of the developing bias shown in FIG. 4. Unlike FIG. 4, the movement time of the photosensitive member is omitted. More particularly, in FIG. 5, the movement period of the photosensitive member from the primary charging position to the developing position, and the movement period from the developing position of the photosensitive member and the transfer position, are omitted. In FIG. 5, an image formation start signal is supplied to the image forming apparatus by copy button or the like, and thereafter, two sheets are continuously processed. The sizes of the original and the transfer materials are the same, however the image of the original is reduced when formed on the transfer material, and therefore, the blank area at the trailing edge of the transfer material is larger than the blank area at the leading edge of the transfer material.

In FIG. 5, the central charging bias voltage for the image formation is −600 V similarly to FIG. 4, and the developing bias voltage is −200 V, and the central charging bias voltage for the formation of the blank on the transfer material is −300 V, and the developing bias voltage therefor is −350 V. The transfer bias voltage applied to the transfer roller 108A is k−4 KV at least when the transfer material is in the transfer position, and a cleaning bias voltage of +2 KV is applied to return the toner from the transfer roller to the photosensitive member during at least a part of the period without the transfer material at the transfer position. When +2 KV is applied to the transfer roller as the cleaning bias voltage, the memory tends to be produced in the photosensitive member if the potential of the photosensitive member at the transfer position is 0 V. When the transfer roller is supplied with +2 KV as the cleaning bias as shown in FIG. 5 in order to prevent the memory, the potential of the photosensitive member at the transfer position is −300 V. The potential to Which the photosensitive member is charged by the charging member is substantially the same as the center of the charging bias. Therefore, the photosensitive member is prevented from being charged to the positive polarity. As shown in FIG. 5, the charging bias center for providing the blank area at the trailing edge of the transfer material and the charging bias center for prevention of the memory when the transfer roller is supplied with The cleaning bias voltage, are the same −300 V. Therefore, according to this embodiment, there is no need of switching the center of the bias-voltage, since the center of the bias voltage applied to the charging member is −300 V when The area of the image bearing member with which the transfer roller is cleaned and the area of the image bearing member corresponding to the blank area, are passed through the primary charge station.

In this embodiment, in order to provide satisfactory leading and trailing edge, the switching period of $X \leqq T \times VPS \leqq 10$ mm is satisfied by the switching period.

This embodiment provides the following advantage.

(1) Since the voltage difference of the charging member between the non-image formation period and the image formation period is small, and therefore, the overshooting upon the switching and the rash current can be reduced.

(2) By synchronization between the developing bias voltage and the charging bias voltage upon the shifting, sharper leading and trailing edges can be provided.

(3) When a contact type transfer means such as transfer roller or the like is used, the production of memory in the image bearing member can be prevented even if the voltage of the same polarity as the charging polarity of the toner is applied to the transfer member when no transfer material is present at the transfer position (the interval between adjacent sheets).

In the foregoing embodiment, the blank areas are provided at the leading or trailing edge of the transfer material. This is not limiting.

In a further embodiment, the non-image area (masking) can be provided at a desired position without complicated apparatus, in a simple image forming apparatus similar to that of FIG. 1.

When the non-image area is to be provided from the position L mm away from the leading edge of the original to the position L' mm therefrom, the data L and L' are inputted in a controller (microcomputer) 140 (FIG. 39). When the original D is fed to the original platen glass 151, the leading edge of the original is detected by an original sensor (photosensor for example, not shown), and the central voltage of the applied voltage is shifted so as to provide the non-image area, for the area from L mm to L' mm, by which the image formation can be prohibited from the position L mm from the leading edge of the original to the position L' mm therefrom.

(2) When the image is formed with a reduced scale, the length of the image is frequently shorter than the length of the transfer material. In this case, the applied voltage to the charging member 103 is shifted in synchronism with the image scanning.

In these cases (1) and (2), the leading and trailing edge of the image are not necessarily adjacent the ends of the transfer material P, but may be at the central portion of the transfer material. Therefore, the edges are preferably sharp and the deviation between the high density portion and the intermediate density portion can be reduced. Therefore, similarly to the foregoing, the following is satisfied:

$$X \leqq t \times VPS \leqq 10 \text{ mm.}$$

Further preferably, $$X \leqq t \times VPS \leqq 8 \text{ mm.}$$

In the foregoing, the center of oscillation of the oscillating voltage applied to the charging member is shifted. Alternatively, however, the charging meddler 103 may be supplied with a DC voltage which is shifted. When a DC voltage is applied, the photosensitive member is charged to the potential corresponding to the potential difference between the applied voltage and the charge starting voltage. Therefore, when the charge starting voltage determined by the property of the photosensitive member 102 and/or the charging member 103 is 550 V, (1) during image formation −1150 V is applied, and during nonimage formation, it is shifted to −550 V.

(2) −850 V for example is applied during the non-image formation and the photosensitive member 102 is charged to the intermediate voltage (−300 V) as in Embodiment 2, and the developing bias voltage is synchronously shifted to −350 V for example to provide the non-image area.

In the foregoing examples, the charging member is in the form of a roller. However, it may be another type such as blade, brush or another contact type.

While the invention has been described with reference to the structures disclosed herein, it is not confined to the details set forth and this application is intended go cover such modifications or changes as may come within the purposes of the improvements or the scope of the following claims.

What is claimed is:

1. An image forming apparatus comprising:

an image bearing member for bearing an image;

a charging member contactable to said image bearing member to electrically charge said image bearing member;

toner image forming means for forming a toner image by applying toner onto the electrically-charged image bearing member;

transfer means for transferring the toner image from said image bearing member onto a transfer material;

control means for switching a potential applied to said charging member to form a blank area at a predetermined position on the transfer material;

wherein the following is satisfied for formation of the blank area;

$$X \leqq t \times VPS \leqq 10$$

where VPS (mm/sec) is a moving speed of said image bearing member, t (sec) is a switching period of said control means, and X (mm) is a distance from a charge starting position to a charge ending position in a direction of movement of said image bearing member.

2. An apparatus according to claim 1, wherein the following is satisfied $X \leqq t \times VPS \leqq 8$.

3. An apparatus according to claim 1, wherein said toner image forming means comprises developing means for providing the toner image, wherein a potential applied to said developing means is switched for formation of the blank area.

4. An apparatus according to claim 1, wherein an area of said image bearing member which corresponds to the blank area is made 0 V by said charging member.

5. An apparatus according to claim 1, wherein an area of said image bearing member which corresponds to the blank area is charged to non-zero voltage to a potential lower than a potential of said image bearing member corresponding to a non-blank area of the transfer material.

6. An apparatus according to claim 1, wherein said blank area includes a leading or trailing edge portion of the transfer material.

7. An apparatus according to claim 6, wherein said transfer means comprises a transfer member contactable to a transfer material remote from said image bearing member, and is supplied with a voltage having a polarity opposite from a charging polarity of said charging member while a first area of said image bearing member passes by the transfer member without a transfer material between the transfer member and said image bearing member.

8. An apparatus according to claim 7, wherein the opposite polarity voltage has the polarity which is the same as a charge polarity of the toner image.

9. An apparatus according to claim 8, wherein toner deposited on the transfer member can be returned to said image bearing member when the first area passes through a transfer position.

10. An apparatus according to claim 7, wherein the first area and a second area of said image bearing member which corresponds to the blank area, are equally charged to a predetermined potential by said charging member.

11. An image forming apparatus comprising:

an image bearing member for bearing an image;

a charging member for electrically charging an image bearing member;

toner image forming means for forming a toner image by applying toner onto the electrically-charged image bearing member;

transfer means for transferring the toner image from said image bearing member to a transfer material;

said transfer means includes a transfer member contactable to a side of the transfer material remote from said image bearing member, wherein said transfer member is supplied with a voltage of a polarity opposite from a charging polarity of said charging member without the transfer material at a transfer position when a first area of image bearing member passes through the transfer position;

control means for switching a potential applied to said charging member to form a blank area including an end portion of a transfer material with respect to a movement direction of said image bearing member;

wherein said first area and a second area of said image bearing member which corresponds to the blank area, are charged to a predetermined potential by said charging member.

12. An apparatus according to claim 11, wherein said toner image forming means comprising developing means for providing the toner image, wherein a potential applied to said developing means is switched for formation of the blank area.

13. An apparatus according to claim 11, wherein an area of said image bearing member which corresponds to the blank area is charged to non-zero voltage to a potential lower than a potential of said image bearing member corresponding to a non-blank area of the transfer material.

14. An apparatus according to claim 12, wherein an area of said image bearing member which corresponds to the blank area is charged to non-zero voltage to a potential lower than a potential of said image bearing member corresponding to a non-blank area of the transfer material.

15. An apparatus according to claim 11, wherein the opposite polarity voltage has the polarity which is the same as a charge polarity of the toner image.

16. An apparatus according to claim 15, wherein toner deposited on the transfer member can be returned to said image bearing member when the first area passes through a transfer position.

17. An apparatus according to any one of claims 11–16, wherein said charging member is contactable to said image bearing member to charge said image bearing member.

* * * * *

UNITED STATES PATENT AND TRADEMARK OFFICE

CERTIFICATE OF CORRECTION

PATENT NO. : 5,600,413

DATED : February 4, 1997

INVENTOR : Shigeo Kimura

It is certified that error appears in the above-identified patent and that said Letters Patent is hereby corrected as shown below:

COLUMN 2

Line 7, "Shifting" should read --shifting--.

COLUMN 4

Line 3, "starking" should read --starting--; and
Line 63, "-600 v" should read -- -600 V--.

COLUMN 5

Line 66, "reading" should read --leading--.

COLUMN 6

Line 32, "The" should read --the--.

COLUMN 7

Line 31, "k-4 KV" should read — -4 KV—.
Line 43, "Which" should read --which--;
Line 50, "The" should read --the--; and
Line 54, "The" should read --the--.

UNITED STATES PATENT AND TRADEMARK OFFICE

CERTIFICATE OF CORRECTION

PATENT NO. : 5,600,413

DATED : February 4, 1997

INVENTOR : Shigeo Kimura

It is certified that error appears in the above-identified patent and that said Letters Patent is hereby corrected as shown below:

COLUMN 8

Line 50, "meddler" should read --member--; and
Line 58, "nonimage" should read --non-image--.

COLUMN 9

Line 3, "go" should read --to--.

Signed and Sealed this

First Day of July, 1997

Bruce Lehman

*Attest:*

BRUCE LEHMAN

*Attesting Officer*

*Commissioner of Patents and Trademarks*